US007543820B2

(12) United States Patent
King

(10) Patent No.: US 7,543,820 B2
(45) Date of Patent: Jun. 9, 2009

(54) PAINTBALL TARGETS WITH ENTERTAINMENT VALUE

(76) Inventor: Richard King, 822 Windstream Way, Unit C, Edgewood, MD (US) 21040

( * ) Notice: Subject to any disclaimer, the term of this patent is extended or adjusted under 35 U.S.C. 154(b) by 0 days.

(21) Appl. No.: 11/728,422

(22) Filed: Mar. 26, 2007

(65) Prior Publication Data

US 2007/0273100 A1 Nov. 29, 2007

Related U.S. Application Data

(60) Provisional application No. 60/785,691, filed on Mar. 24, 2006.

(51) Int. Cl.
*F41J 7/04* (2006.01)
*F41J 5/14* (2006.01)

(52) U.S. Cl. ..... 273/390

(58) Field of Classification Search ..... 273/390–392
See application file for complete search history.

(56) References Cited

U.S. PATENT DOCUMENTS 1,489,191 A * 4/1924 Chester ..... 273/357
2,133,552 A * 10/1938 Long ..... 273/392
2,472,297 A * 6/1949 Holt ..... 273/380
2,558,257 A * 6/1951 Koepnick ..... 273/380
2,691,526 A * 10/1954 Wesley et al. ..... 273/359
3,103,362 A * 9/1963 Elofson ..... 273/359
3,814,429 A * 6/1974 Lienhard ..... 273/368
3,861,684 A * 1/1975 Gastin et al. ..... 273/287
3,921,980 A * 11/1975 Artzer ..... 273/405
4,223,894 A * 9/1980 Fabricant ..... 273/349
4,773,652 A * 9/1988 Mosser ..... 273/392
6,478,301 B1 * 11/2002 Witmeyer ..... 273/391

* cited by examiner

*Primary Examiner*—Mark S Graham
(74) *Attorney, Agent, or Firm*—Ober/Kaler; Royal W. Craig

(57) ABSTRACT

Paintball targets including a battleship having an array of smaller targets pivotally mounted on a base that is shaped to resemble the shape of a ship's hull. The smaller targets are designed to swing back on a hinge to display an image of fire and destruction, upon the impact of a paintball projectile on the target's face, thus visually providing the user with the satisfaction of knowing that he/she has destroyed the intended target. A vortex drive track is also disclosed having multiple spinning targets each carried on a corresponding cord that is suspended at a slight angle. When a target is hit by a paintball projectile it spins on its cord. This vertical rotation, along with the downward slope of the cord, and the assistance of gravity will force the target to progress down the cord.

2 Claims, 5 Drawing Sheets

PAINTBALL TARGETS WITH ENTERTAINMENT VALUE

CROSS-REFERENCE TO RELATED APPLICATION(S)

The present application derives priority from U.S. provisional application Ser. No. 60/785,691 filed Mar. 24, 2006.

FIELD OF THE INVENTION

The present invention relates to the sport of paintball, more specifically, to an array of target systems utilized by the participants while playing the game, competing and testing their accuracy. These target systems all provide an element of entertainment to those using it or observing its use.

BACKGROUND OF THE INVENTION

Shooting ranges and target games have long existed for firearms in a variety of formats. For example, there are simple paper targets or human silhouettes. More elaborate shooting ranges include pop-up targets. All of these targets are designed to sharpen shooting skills, but in a very serious way. The play value of such targets is relatively small. Paintball, on the other hand, is primarily an enjoyment sport. Indeed, paintball has become an extremely popular pastime. The sport is fast paced and competitive, and is considered one of the fastest growing sports in America with more than seven million participants.

The guns used to fire the paintballs are referred to as "markers". Current paintball markers have evolved into very sophisticated devices, now semi-automatic or fully automatic, each paintball being loaded into firing position automatically. Despite the sophistication of the markers, participants are left to hone their skills using conventional targets on conventional ranges, usually an array of common items arranged in a netted shooting gallery. There have been just a few efforts to make the gallery more convenient.

For example, U.S. Pat. No. 5,251,906 described a revolving turnable 19 for receiving balls 11 falling downwardly after striking the target 12 and dispensing the balls 11 one at a time through an outlet 21 into the tube 18.

U.S. Pat. No. 6,162,057 shows a movable shooting range within a trailer with fans, filters, air conditioning, lightweight, hardened alloy ceilings, floors and side walls. U.S. Pat. Nos. 6,217,026 and 6,338,487, as well as U.S. patent application No. 2001/0008329 describe a game system including a bullet-supply device for feeding back the shot bullet to a pneumatic gun and a communication line connecting the bullet-supply device to the pneumatic gun.

United States Patent Application 20050242507 by Patterson et al. shows a paintball shooting range includes a housing, a plurality of shooting booths each set with a paintball marker and located at a first end of the housing, a control area located at the first end of the housing and shielded with paintball-proof means, and a target area set with targets. The gallery is enclosed in a trailer.

While these prior efforts may make the collection and recycling of paintballs more convenient, none attempt to increase the enjoyment and entertainment value for participants by making the targets themselves more interesting and enjoyable.

Accordingly, it would be greatly advantageous to provide paintball targets that have a distinct enjoyment and entertainment value for participants that strike the targets with a paintball projectile, in each case by a target activation mechanism that indicates that a particular target has in fact been hit.

SUMMARY OF THE INVENTION

The primary object of the present invention is to provide enjoyment and entertainment value for users with the value arising from the actions performed by the various paintball targets upon being struck on their face with a paintball projectile fired by the user.

In a preferred embodiment of the present invention a series of paintball targets are arranged to give the appearance and shape of a battleship. These targets are set upon a base that is shaped to resemble the shape of a ship's hull and are designed to swing back on a hinge to display an image of fire and destruction, upon the impact of a paintball projectile on the target's face, thus visually providing the user with the satisfaction of knowing that he/she has destroyed the intended target. The target bottoms of the larger sized targets are weighted with varying amounts of weight depending on the size of the corresponding target in order to keep them from pivoting unless after being positively struck by a paintball projectile. The base, which is approximately five feet long, is hinged in the middle to allow it to fold in half for easier transport and storage. A potential color scheme will be dark battleship gray for the base (hull), light battleship gray for the targets, and the bright colors of fire on the bottom area of the targets that is exposed when the target rotates back on its hinge.

In another preferred embodiment of the present invention the target comprises a vortex drive track having multiple spinning targets each carried on a corresponding cord that is suspended at a slight angle. When a target is hit by a paintball projectile it spins on its cord. This vertical rotation, along with the downward slope of the cord, and the assistance of gravity will force the target to progress down the cord. This will provide users with not only enjoyment and entertainment at forcing the target across the track but since there are multiple tracks and thus multiple targets there is also an element of competition involved as multiple persons will be able to compete to see who can get their target across the length of the track first.

DETAILED DESCRIPTION OF THE PREFERRED EMBODIMENT

The present invention is an array of paintball targets designed to provide significant enjoyment and entertainment value for users as a result of the actions performed by the various paintball targets upon being struck on their face with a paintball projectile fired by the user. Three exemplary target series are disclosed herein, including a Destroy the Battleship target series and a Vortex Drive Track target series.

Figure 1:
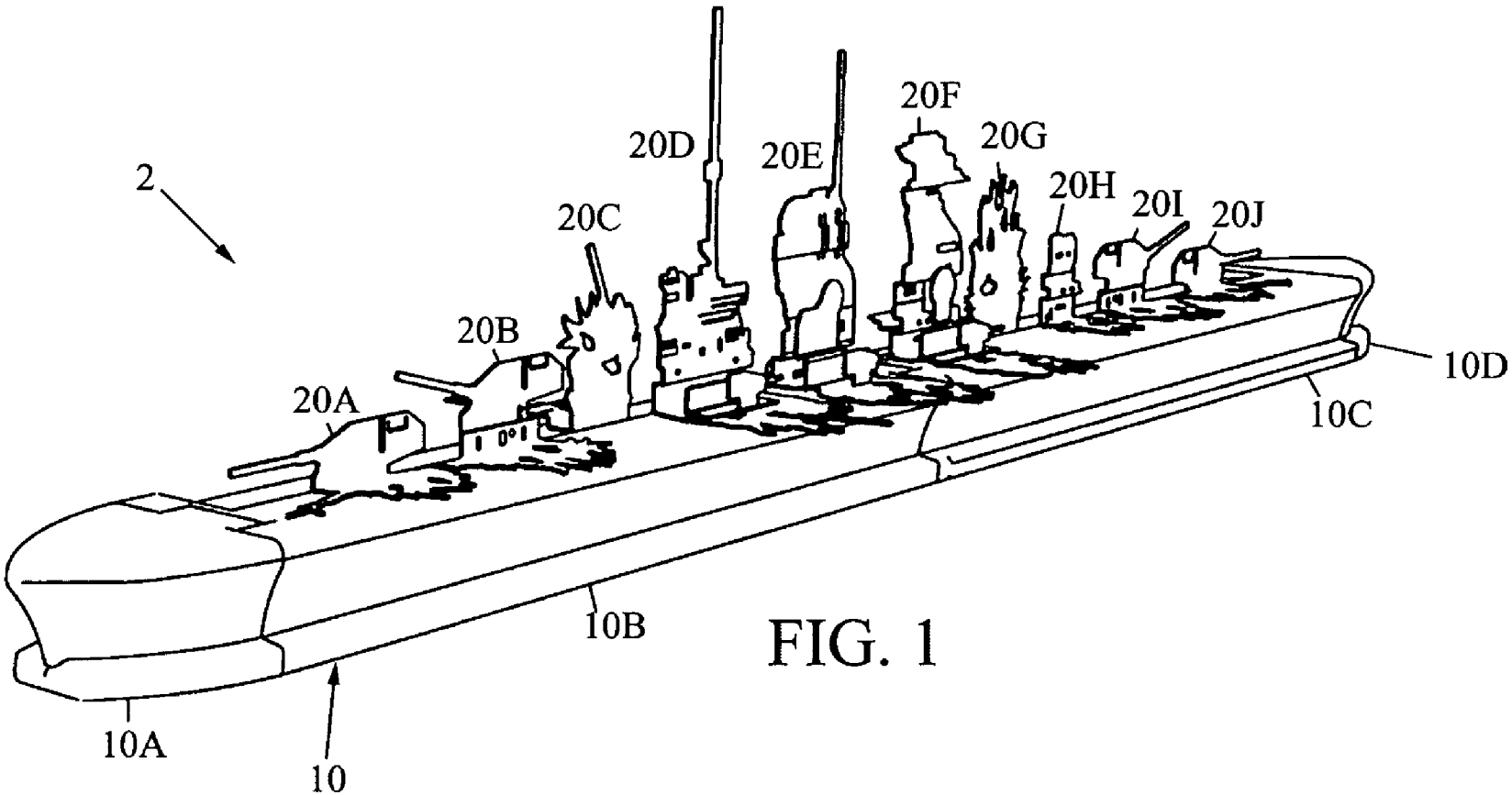
FIG. 1 is a front perspective view of a destroy the battleship target 2 according to one embodiment of the present invention.

FIG. 1 is a front perspective view of the destroy the battleship target 2. The entire battleship target 2 may be constructed from metal, wood or plastic-molded materials as desired. The Battleship target 2 generally includes an elongate base 10 preferably formed in multiple interlocking sections 10A-D that join end-to-end in the shape of a battleship target 2 hull.

There are multiple articulating targets 20A-J pivotally seated atop the base 10. As best seen in the cross-section of FIG. 2, each target 20 further comprises a vertically-oriented battleship feature 22 integrally joined to perpendicular explosion scene 24. The vertically-oriented battleship feature 22 is joined to the explosion scene 24 along an edge 30, and the edge 30 is pivotally attached by a hinge 40 to base 10. In addition, the target 20 includes a ballast weight 50 protruding upward from the explosion scene 24 portion of the target 20. The ballast weight 50 may also serve as a red target area. A certain amount of ballast weight is necessary to offset the weight of the vertical target 22, and additional ballast weight can be added beyond that to require a direct frontal hit (rather than a glancing shot) in order to knock the vertical target 22 down.

The targets 20A-J are of different sizes and shapes and are arranged front-to-back along the base 10 to generally give the perception of a complete battleship viewed from the front. Thus, the targets 20A-J generally begins with low-lying gun turrets 20A, 20J at each end, higher gun turrets 20B, 20I, depth charge ejectors 20C, 20H, as well as various other towers. In the illustrated embodiment there are ten battleship features ranging from smallest at the ends to a main control tower 20D at the center. The widths of the vertical targets 20 decrease toward the center of the base 10 to make the central features (such as control towers 20D, 20E harder to hit. The target the explosion scenes 24 are preferably cut in the jagged shape of a fiery explosion and is brightly colored or laminated to give this effect.

The base 10 is preferably approximately 5 feet in length and may be constructed from metal (steel, iron, etc.), wood, or other suitable materials. The base 10 may be formed in multiple interlocking sections 10A-D that join end-to-end in the shape of a battleship target 2 hull, or may be formed in two or more hinged sections that collapse for portability (the base 10 can be folded in half downward for transport and storage).

Figure 3:
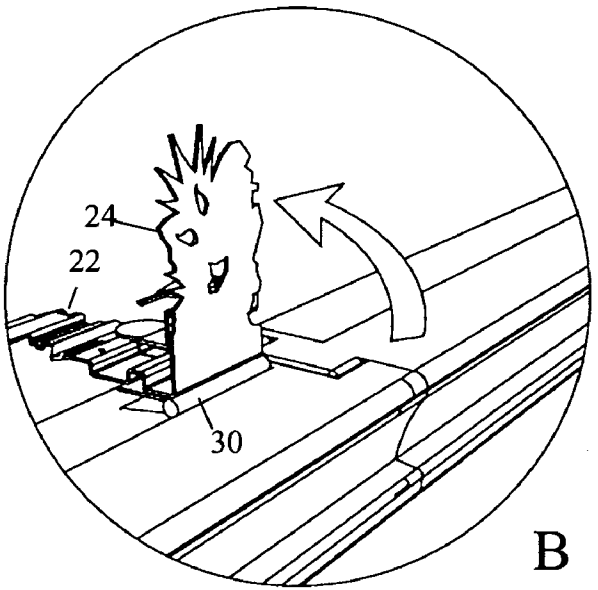
FIG. 3 is a perspective view with inset illustration that collectively illustrates the operation, inclusive of a view from the front before (A) and after (B) the impact of a paintball projectile.
Figure 3:
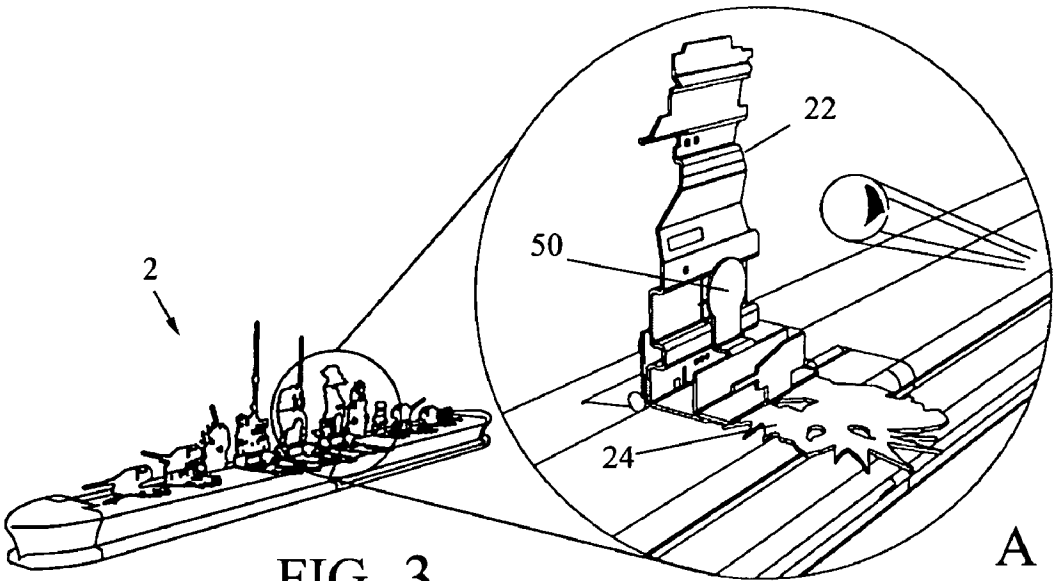

FIG. 3 is a perspective view with inset illustration that collectively illustrate the operation, inclusive of a view from the front before (A) and after (B) the impact of a paintball projectile. Each vertically-oriented battleship feature 22 is attached to the explosion scene 24 at a 90 degree angle so that when the explosion scene 24 is sitting flat on the base 10 the fire and destruction image is facing downward and the target 20 is standing upright with the target area facing the shooter. Each target 20 may be formed from a single angled member with 90-degree battleship feature 22 integrally joined to the explosion scene 24, and the hinge 40 may be a standard door hinge having one flange joined to base 10 and the other joined to the target 20 at the intersection 30. Shooters will take aim at the targets 20 and fire. When a target is struck the impact of the paintball on the ballast 50 or the battleship feature 22 will cause the target 20 to pivot backward. This backward pivoting will cause the explosion scene 24 to flip upward to give the appearance of fire and destruction now facing the paintball shooters. This action will provide the shooter with the knowledge, enjoyment and entertainment value that he/she has destroyed the target. Destroying all the targets 20 places the entire ship in flames and sinks it.

Figure 4:
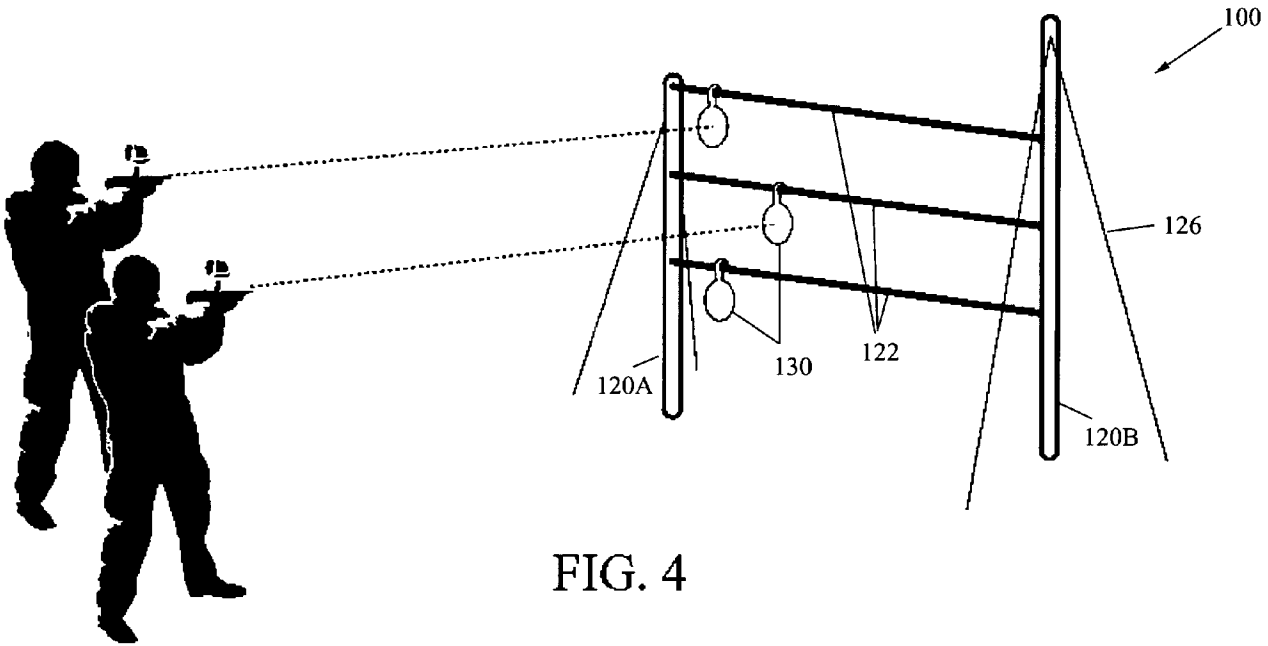
FIG. 4 shows a front perspective view of a second embodiment 100 of the present invention entitled the vortex drive target.
Figure 5:
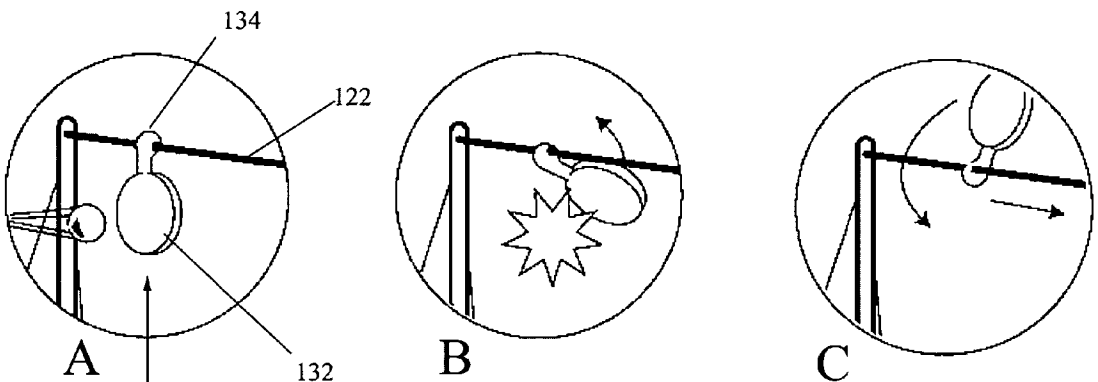
FIG. 5 is a composite of enlarged views of the vortex drive unit 100 as in FIG. 4.

FIG. 4 shows a front perspective view and FIG. 5 shows composite enlarged views of a second embodiment 100 of the present invention entitled the vortex drive target. This embodiment comprises an open square frame formed two vertical side supports 120A, 120B. The side supports 120A, 120B may be reinforced by tether cables 126 as desired. A plurality of smooth galvanized steel drive rods 122, or alternatively, cables, extend between the side supports 120A from one side to the other side a downward slope. The degree of the slope is approximately 22 degrees below horizontal. Each drive rod 22 bears a vortex target 130 formed of a yoke 134 and attached hanging target 132, and the corresponding drive rod 22 passes through the yoke 134. The target 132 can be of any size and shape, possibly depicting a cartoon face, a race car, a race horse, or other drawings or designs. The collar 134 has a hole that is slightly larger than ½ inches in diameter to allow the vortex drive rod 122 to pass through the hole. The inside edges of the hole are formed with a smooth surface in order to permit the vortex drive unit to rotate freely around the vortex drive rod 122. When this target system is fully assembled the vortex drive rods 122 pass through the vortex drive collars 134 and allow the target block 132 to hang in a position so that when viewed from the front facing toward the shooter.

In the illustrated embodiment, each side support 120A, 120B is approximately 2 inches in diameter and approximately 6 feet tall. Each side support is equipped with a base of sufficient length, width and weight to support the side supports 120A, 120B in an upright position. Since the vortex drive rods 22 slope downward from one side support 20A to the other the points of attachment to the first side support will be higher than the corresponding points of attachment on the second side support. The drive rods 122 may be round rods with a diameter of approximately ½ inch, and may be formed from smooth galvanized steel or another suitable equivalent.

As seen in FIG. 5(A), users shoot paintballs at the hanging targets 132 and, upon hitting one as shown at 5(B), this causes the vortex target 130 to spin about the drive rods 122, which in turn (by virtue of the rotation and gravity of the downward sloping drive rods 122) urges the vortex target to spin downwardly along the drive rod 122 as seen at 5(C). When friction stops rotation, the vortex target 130 stops in place.

The illustrated target system possesses multiple targets 130 on multiple drive rods 122 so that multiple shooters can compete against each other to see which shooter can advance their target across the entire length of the vortex drive rod 122 the fastest. When the paintball shooter is facing this target system the targets will initially be placed at the higher end of the vortex drive rods 122. The shooter will aim at the target block 132 and fire paintballs at the target block 132. It is contemplated that multiple users will be assigned one vortex target 130 each, and will race their vortex targets 130 from side to side. Whoever hits their assigned vortex target most frequently will succeed in being the first to move their vortex target all the way from side to side, winning the race and the game.

Figure 6:
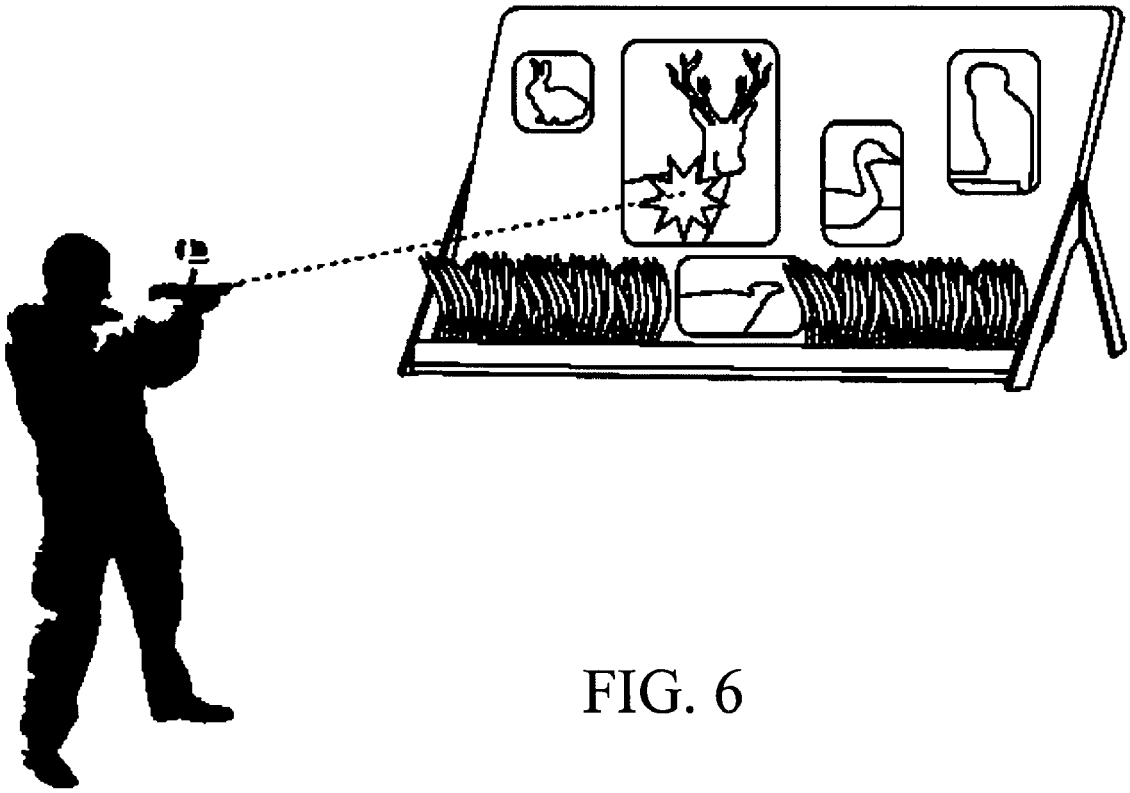
FIGS. 6 and 7 illustrate alternative embodiments of paintball targets.
Figure 7:
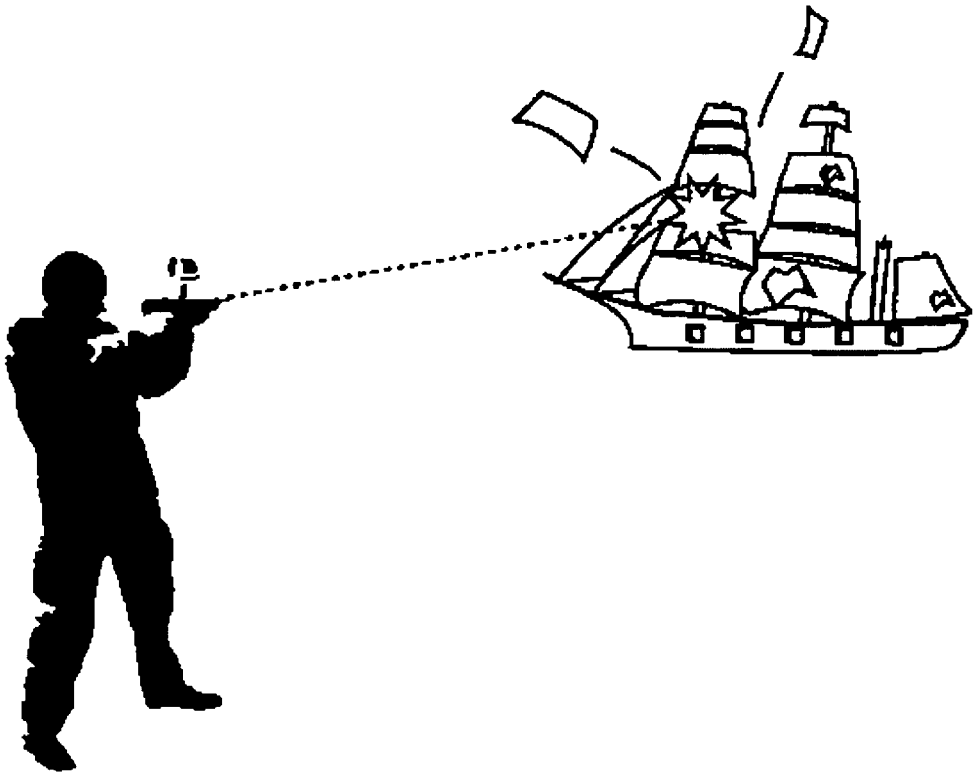

FIGS. 6 and 7 illustrate alternative embodiments of the paintball targets.

Figure 2:
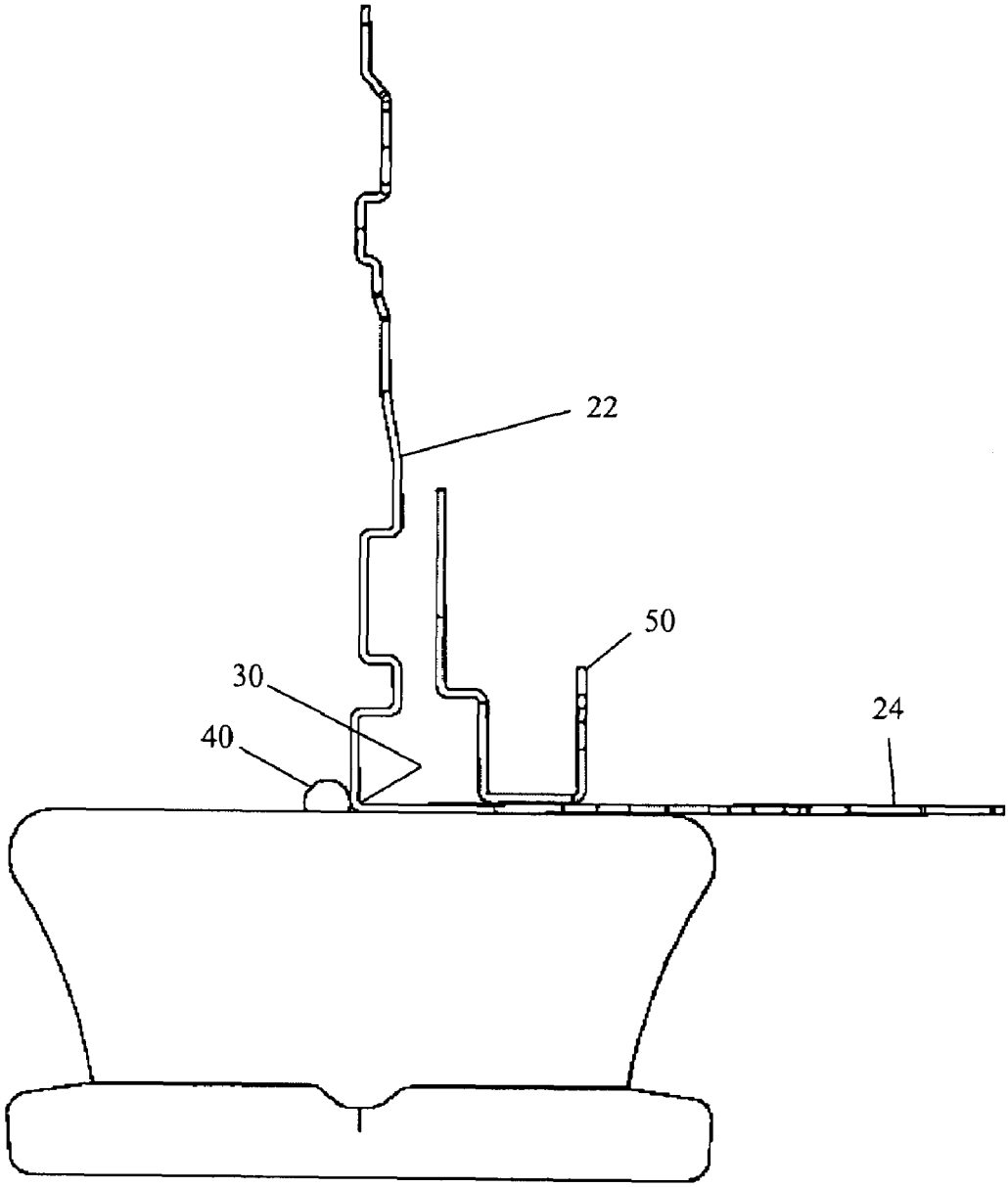
FIG. 2 is a side cross-section of the battleship target 2 as in FIG. 1.

The embodiment of FIG. 6 is similar to the destroy the battleship target 2 of FIGS. 1-3, except that the targets 30 are replaced with game animals to provide a hunting simulation. As before there are multiple articulating targets pivotally mounted behind a scene board and visible through apertures.

The embodiment of FIG. 7 illustrates how pivoting targets 30 can be replaced by components that dislodge and fly off, rather than pivot.

In all the foregoing examples the inventive concept provides paintball targets that have a distinct enjoyment and entertainment value for participants that strike the targets with a paintball projectile, in each case by a target activation mechanism and graphics that indicates that a particular target has in fact been hit.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A battleship target for paintball, comprising:

an elongate base in the shape of a ship hull;

a plurality of articulating targets mounted atop the base, each target further comprising, a horizontal platform having a front edge and a rear edge, a top surface and a bottom surface and bearing an image of a destroyed target on its bottom surface, and a vertical target section having a front surface and a back surface and bearing a target image on its front surface attached at a right angle to and extending upward from the rear edge of the horizontal platform;

at least one ballast weight in communication with the top surface of horizontal platform; and a hinge rotatably connecting the rear edge of the horizontal platform to said base;

whereby the vertical target seetion is caused to rotate upon impact of said paintball on said target image rotating the horizontal base into a vertical position thereby displaying its bottom surface and the destroyed target image thereon.

2. The target of claim 1 wherein said balance weight is fixedly attached to the top surface of the horizontal platform.

* * * * *